United States Patent [19]

Mulder

[11] Patent Number: 4,710,286

[45] Date of Patent: Dec. 1, 1987

[54] SIEVE FOR POWDER

[75] Inventor: Douglas C. Mulder, Wellington, Ohio

[73] Assignee: Nordson Corporation, Westlake, Ohio

[21] Appl. No.: 419,167

[22] Filed: Sep. 17, 1982

[51] Int. Cl.[4] ..... B07B 1/28

[52] U.S. Cl. ..... 209/250; 209/322; 209/325; 209/357; 209/366.5

[58] Field of Search ..... 209/320–323, 209/325, 250, 357–358, 370–372, 373, 378, 405, 408, 21, 30, 36, 37, 364–365, 262, 263, 366.5; 52/199

[56] References Cited

U.S. PATENT DOCUMENTS

| | | | |
|---|---|---|---|
| 1,249,966 | 12/1917 | Jones | 209/321 |
| 1,873,393 | 8/1932 | Hallam | 209/250 |
| 2,599,641 | 6/1952 | Jurkow | 209/332 |
| 2,616,563 | 11/1952 | Hebb | 209/144 |
| 3,035,699 | 5/1962 | Braderlein et al. | 209/365.1 |
| 3,140,254 | 7/1960 | Katzen | 209/30 |
| 3,263,817 | 8/1966 | Buckley | 209/365.1 |
| 3,439,650 | 4/1969 | Stowell | 209/30 |
| 3,469,694 | 9/1970 | Dickson | 209/332 |
| 3,477,569 | 11/1969 | Klein et al. | 209/144 |
| 3,498,456 | 3/1970 | Childs et al. | 209/325 |
| 3,530,986 | 9/1970 | More et al. | 209/326 |
| 3,710,558 | 1/1973 | Feder | 209/144 |
| 3,791,341 | 2/1974 | Diamond et al. | 118/7 |
| 3,819,049 | 6/1974 | Koerner et al. | 209/370 |
| 3,948,764 | 4/1976 | Edwards | 209/250 |
| 4,000,061 | 12/1976 | Bowling et al. | 209/250 |
| 4,284,500 | 8/1981 | Keck | 209/250 |

FOREIGN PATENT DOCUMENTS

| | | | |
|---|---|---|---|
| 1902225 | 7/1970 | Fed. Rep. of Germany | 52/199 |
| 1527644 | 4/1968 | France . | |
| 1197234 | 7/1970 | United Kingdom . | |
| 1401631 | 7/1975 | United Kingdom . | |
| 2065507 | 7/1981 | United Kingdom . | |

OTHER PUBLICATIONS

Xerox Disclosure Journal, Sep./Oct. 1977, vol. 2, No. 5, pp. 55–56.

*Primary Examiner*—Charles Hart

*Attorney, Agent, or Firm*—Wood, Herron & Evans

[57] ABSTRACT

A sieve for powder. The sieve has a housing in which a transverse screen is mounted to divide the housing into upper and lower chambers. Air under pressure carries powder into a cyclone stack mounted on top of the housing from which it is directed onto the screen. A vibrator is connected to the screen to vibrate and thus to assist in the sieving operation. The screen is downwardly inclined and overlying its lower end an inspection cover is mounted in the housing to permit access to the screen for removal for the material which does not pass through the screen.

1 Claim, 2 Drawing Figures

SIEVE FOR POWDER

Figure 1:
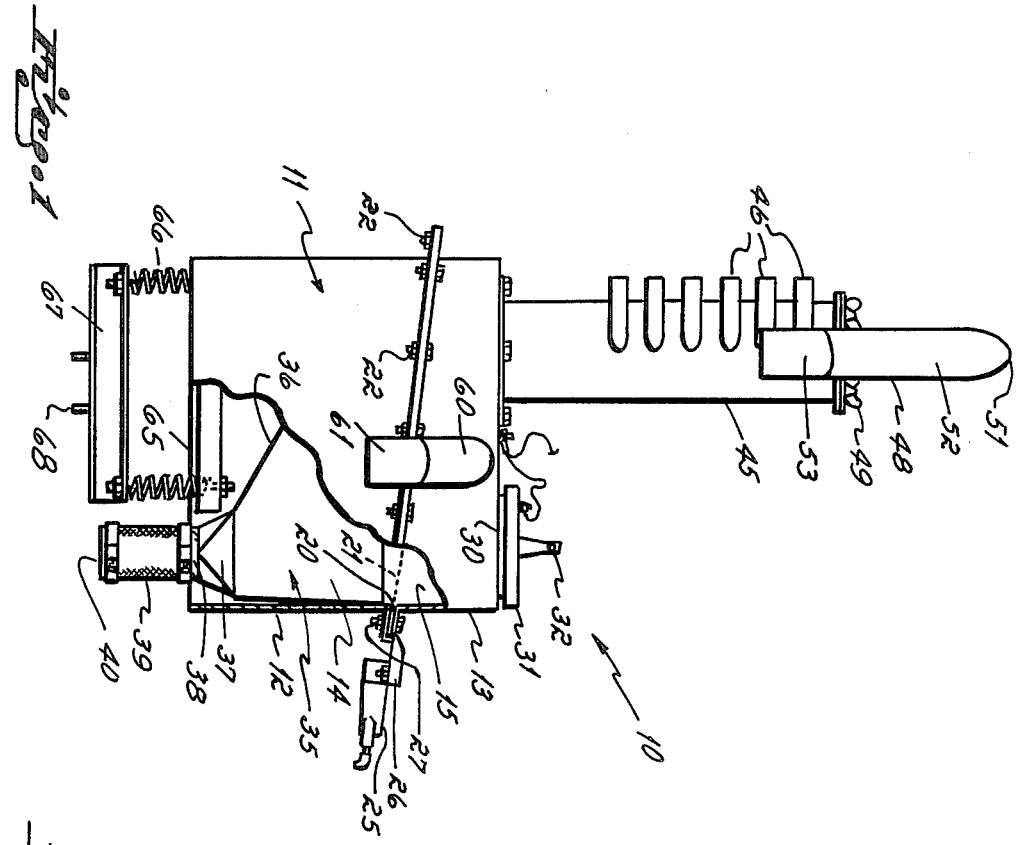

This invention relates to a sieve for powder of the type which is used to apply a finish to products.

In the operation of the industrial powder booth wherein the finishing occurs, powder for the finishing operation comes from two principal sources. The first is the bulk supply of new powder, and the second is reclaimed powder which was introduced into the spray booth but which did not adhere to the product. The powder from those two sources is accumulated and thereafter picked up by a transfer pump and conveyed at relatively high pressure into a sieve. The sieve is divided into upper and lower chambers by a screen, the powder under pressure being delivered to the upper chamber. The sieve is vibrated, causing the fine powder particles to pass through the screen while large particulate material as well as trash is collected on the top of the screen. The lower chamber is connected to a feeder which picks up the powder and drives it into the powder booth.

The prior sieve on which the present invention is an improvement had several disadvantages. The screen was difficult to inspect and clean of the trash and large particles. It had a vertical access door which tended to leak, depositing powder in the work area. The sieve was difficult to mount to the feeder hopper and tended to vibrate the feeder hopper unduly. The sieve required air amplifiers in the venting apparatus in order to minimize the pressure on the screen of the incoming powder.

The objective of the present invention has been to provide improvements in several areas of the prior sieve, including access for cleaning and inspection, the venting of the sieve, the mounting of the sieve to the feeder, the vibrating mechanism and the access to the screen.

This objective has been attained by providing a housing formed as an upper section and a lower section. The housing is provided with flanges between which the screen is mounted. The vibrator is positively attached to one of the flanges and the screen lying between it and thus is able to more positively vibrate the screen.

Spring legs secure the sieve to a mounting base, the mounting base in turn being mountable upon the feeder. The spring legs absorb vibrations and minimize their transmission to the feeder. The mounting base facilitates the mounting of the sieve to the feeder at the finishing plant.

Extending above the housing is an elongated, cylindrical cyclone housing having six tangential inlet ports which are normally connected to the several sources of powder to be screened. The cyclone housing structure per se is old. A feature of the present invention, however, is to provide a relief port in the form of an inverted V-shaped stack at the top of the cyclone housing, the stack having an upwardly inclined section connected at its upper end to a downwardly inclined section. The stack is connectable to a hose by which entrained air is passed to a collector. This stack adequately relieves the pressure of the incoming air which would otherwise drive the powder against the screen and cause it to "blind" and performs that function without the need for air amplifiers.

The screen is inclined at an angle of about 10° to horizontal. Overlying the lower end of the screen where large particles and trash collect is an inspection cover which can easily be opened to provide access to the screen enabling it to be easily cleaned.

Figure 2:
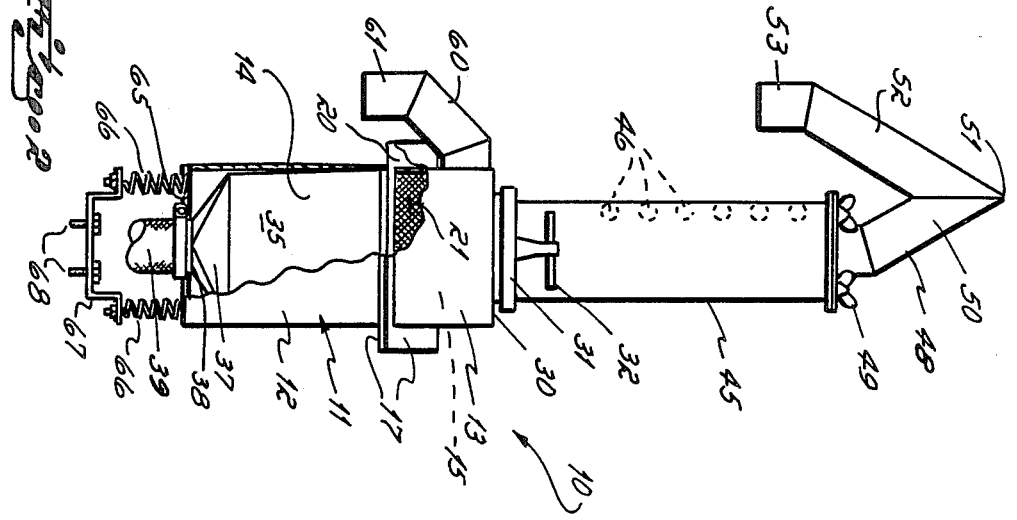

The several features and objectives of the present invention will become more readily apparent from the following detailed description taken in conjunction with the accompanying drawings in which:

FIG. 1 is a diagrammatic side elevational view of the sieve of the present invention; and FIG. 2 is an end elevational view of the sieve of the present invention.

The sieve, indicated at 10, includes a housing 11. The housing has a lower section 12 and an upper section 13 which form lower and upper chambers 14 and 15, respectively. Both sections have mating perimeter flanges 17 between which the perimeter 20 of a screen 21 is captured. Bolts 22 pass through mating holes in the flanges and screen to securely bolt the upper and lower sections together with the bolts passing through the screen perimeter 20.

The screen is inclined to a horizontal plane at an angle of about 10°. At the lower end of the screen a pneumatic vibrator 25 is attached to the flanges 17 as well as the screen sandwiched therebetween by a bracket 26 which is in turn attached to the flanges by bolts 27.

Overlying the lower end of the screen and mounted at the top wall 30 of the housing is an inspection cover 31. The inspection cover has a handle 32 by which it may be conveniently lifted off the housing to present an opening through which the trash and large particles collected at the lower end of the screen may be picked up.

Immediately below the screen within the lower chamber 14 is a hopper 35 having a lower floor 36 which is inclined to a horizontal plane by about 30°. At the lower end of the floor 36 is a chute 37 having a discharge opening 38. The discharge opening is attached to a flexible 2" hose 39 having a discharge port 40. When the sieve is mounted on top of a feeder, the sieve will be connected to the feeder by means of the hose 39.

An elongated, cylindrical cyclone housing 45 is bolted to the top of the housing 11. The cyclone housing has six tangential inlet ports 46 which are adapted to be connected to hoses from transfer pumps (not shown) by which powder is introduced under pressure into the sieve. A relief port 48 is mounted to the top of the cyclone housing by wing nuts 49. The relief port 48 is in the form of an inverted V-shaped stack having a first upwardly inclined section 50 whose upper end 51 is connected to a downwardly inclined section 52. The downwardly inclined section is in turn connected to a short vertical section 53 to which a hose is normally attached, the hose leading to a powder collector.

A lower relief port 60 is connected to a side wall of the upper section 13 of the housing 11 to provide additional venting. The relief port 60 terminates in a short section 61 which is also connectable to a hose from which the powder and air can be delivered to a collector.

It is desired that the powder drift downwardly under the influence of gravity onto the screen rather than being driven against the screen at high pressure. If driven against the screen at high pressure, the powder would have a tendency to jam in the screen and thus blind it rendering it ineffective for its screening function. The two relief ports permit the powder to be introduced and swirled around the cyclone housing with the excess air being vented through the upper relief port 48. Some powder will be entrained in that air and that powder passes to a collector from which it can be recycled into the sieve. To the extent that there is a tendency for pressure to build up in the upper chamber of the housing, the lower relief port 60 will relieve that pressure in a similar fashion.

The housing 11 has a bottom wall 65 to which four spring legs 66 are mounted. The spring legs are in turn mounted at their lower ends to a mounting base 67. The mounting base has means including bolt holes and bolts 68 by which it can be mounted to aligned holes in the top of a feeder.

In the operation of the invention, air under pressure is fed to the vibrator 25 to cause it to operate. Because it is directly connected to the screen 21, it vibrates the screen directly. Some of that vibration is of course transmitted to the housing 11, but that vibration will be absorbed by the spring legs with practically none of it being transferred to the feeder to which the sieve is mounted.

Powder is introduced through transfer pumps and hoses to the inlets 46 into the cyclone housing 45. The powder and air swirl around the cyclone housing with the excess air passing out of the relief port 48 and into a collector where any powder entrained in it will be deposited. The bulk of the powder will become loosened through the swirling action in the cyclone housing and will fall primarily by gravity onto the vibrating screen 21. Powder particles small enough to pass the screen will fall into the hopper and will slide along the bottom wall 36 through the discharge port 38 and into the feeder. Larger particles as well as trash will drift slowly down the screen and collect adjacent the lower end of the screen. From time to time the inspection cover 31 will be removed and excess material collected at the lower end of the screen can be removed from the sieve either by troweling it out or through the use of a vacuum cleaner device.

Having described my invention, I claim:

1. A sieve for powder comprising:

a housing formed of an upper section and a lower section, said sections having perimeter flanges, a screen having a perimeter sandwiched between said flanges, said screen thereby extending across said housing and dividing it into an upper chamber and a lower chamber, said screen being inclined to horizontal at an angle of about 10°, an elongated vertically-extending cyclone housing for introducing powder carried by air under pressure into said upper chamber, said elongated vertically-extending cyclone housing having a top cover and inclined stack section projecting vertically at an angle of about 30° to vertical from said top cover, and a downwardly and inclined stack section being at an angle of about 30° to vertical connected to the upper end of said vertical stack section to relieve the pressure of air by which the powder is introduced, a relief port connected to the side of said housing above said screen and below said elongated vertically-extending cyclone housing, an inclined floor at the lower end portion of said lower chamber within said housing, a discharge port in said housing adjacent the lower end of said floor, an inspection cover in the top of said housing overlying the lower end portion of said screen for removal of large particles resting on the lower end portion of said screen, and a vibrator fixedly secured to said flanges and said screen sandwiched therebetween, whereby powder carried by air under pressure entering said elongated vertically-extending cyclone housing will swirl around inside said elongated vertically-extending cyclone housing with excess air passing out of said vertical stack sections and any build up of pressure within said upper chamber being relieved by said relief port, so that the bulk of said powder will become loosened through said swirling action and will drift downwardly under the influence of gravity into said upper chamber and onto said screen so as not to blind said screen.

* * * * *